US005206630A

United States Patent [19]

Kim

[11] Patent Number: 5,206,630

[45] Date of Patent: Apr. 27, 1993

[54] IMPROVED DRIVING CIRCUIT FOR A GASEOUS DISCHARGE DISPLAY DEVICE WHICH PROVIDES REDUCED POWER CONSUMPTION

[75] Inventor: Jung-Hea Kim, Seoul, Rep. of Korea

[73] Assignee: Samsung Electron Devices Co., Ltd., Hwasung-kun, Rep. of Korea

[21] Appl. No.: 631,457

[22] Filed: Dec. 21, 1990

[30] Foreign Application Priority Data

Dec. 23, 1989 [KR] Rep. of Korea ..... 89-19634

[51] Int. Cl.[5] ..... G09G 3/28

[52] U.S. Cl. ..... 340/771; 315/169.4

[58] Field of Search ..... 340/771, 773, 776, 777; 315/169.1, 169.2, 169.3, 169.4; 313/582

[56] References Cited

U.S. PATENT DOCUMENTS

| | | | |
|---|---|---|---|
| 4,183,062 | 1/1980 | Weisbrod | 340/771 |
| 4,292,631 | 9/1981 | Gerard | 340/771 |
| 5,029,257 | 7/1991 | Kim | 340/771 |

*Primary Examiner*—Alvin E. Oberley
*Assistant Examiner*—Richard Hjerpe
*Attorney, Agent, or Firm*—Cushman, Darby & Cushman

[57] ABSTRACT

A driving circuit for a gaseous discharge display device comprises a processing circuit for processing data signals and clock signals and a data input counter connected in parallel and a scanning control circuit connected to the data input counter to control the turning on and off of scan operations so that unnecessary power consumption can be reduced and the contrast ratio enhanced by preventing auxiliary discharge effects from occurring when no data is input for display at the gaseous discharge display device.

3 Claims, 4 Drawing Sheets

IMPROVED DRIVING CIRCUIT FOR A GASEOUS DISCHARGE DISPLAY DEVICE WHICH PROVIDES REDUCED POWER CONSUMPTION

BACKGROUND OF THE INVENTION

1. Field of the Invention

This invention relates to a driving circuit for a gaseous discharge display device, more particularly, to a driving circuit for a gaseous discharge display device wherein a scan operation occurs only when display data is input, while no scan operation occurs when display data is not input onto any one of available column lines.

2. Description of the Art

A gaseous discharge display device includes a matrix electrode. Each matrix electrode comprises a plurality of scan electrode rows and a plurality of signal electrode columns. Pixels are discharged when a voltage is supplied selectively to any crosspoint intersected by a scan electrode row and a signal electrode column.

Conventionally, a scan driving voltage is applied to the scan electrode rows even when display data is not applied to the signal electrode columns. A scan operation is therefore continuous.

For that reason, an auxiliary discharge is generated at a crosspoint intersected by a scan electrode row and a signal electrode column even when display data is not applied to a signal electrode column. Because a scan electrode row applies a scan driving voltage continuously, residual luminance exists when no display data is applied to any of the signal electrode columns.

In a conventional gaseous discharge display device, the driving circuit is therefore constructed such that scanning progresses sequentially up to the maximum number of scan lines corresponding to 1 frame regardless of the presence of data.

Accordingly, since scan lines are driven continuously even while no data is input, unnecessary power consumption becomes a problem. Furthermore, the residual luminance exists because auxiliary discharge is generated even in crosspoints where no data is applied. As a result, since both a main discharge and an auxiliary discharge are generated on the screen, depending on the presence of data, the signal contrast ratio is reduced considerably compared to the case in which only main discharge is generated.

SUMMARY OF THE INVENTION

An object of the present invention is to provide a driving circuit for a gaseous discharge display device, wherein scan operations occur when data is input to at least one of several column lines, if there are a plurality of column lines in a scan line, but no scan operations occur when data is not input into any of the column lines.

Another object of the present invention is to provide a driving circuit for a gaseous discharge display device wherein only a main discharge is generated so that contrast can be improved considerably.

As the technical means to accomplish the above objects, the present invention is characterized by comprising a data input counter and a processing circuit provided between a signal input circuit and a data driving circuit, and a scanning control provided between a control synchronization signal generating processing circuit and a scanning driver circuit, thereby controlling the scanning driver circuit by inputting the data detecting signals output from the processing circuit into the scanning control circuit.

DETAILED DESCRIPTION OF THE PREFERRED EMBODIMENTS

Figure 1:
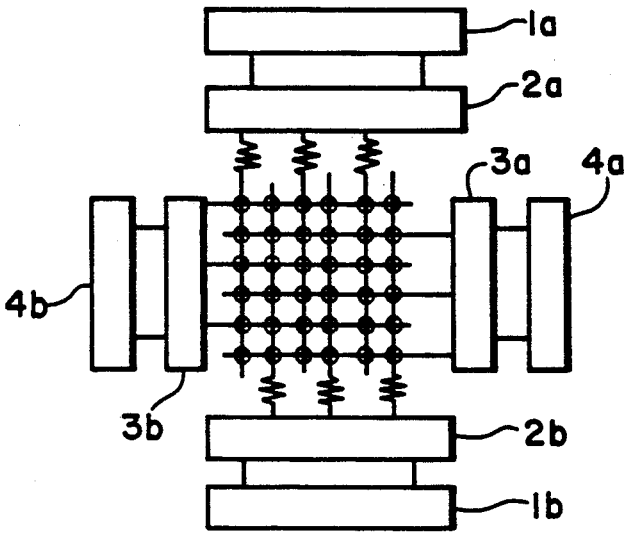
FIG. 1 (PRIOR ART)
FIG. 1 is a structural view of a gaseous discharge display device having a conventional matrix structure.

FIG. 1 shows a block diagram of a gaseous discharge display device having a conventional matrix structure. As shown in the diagram, the gaseous discharge display device comprises control signal generating circuits 1*a* and 1*b* which form part of a data driving circuit device, data signal output circuits 2*a* and 2*b* for receiving control signals from a corresponding control signal generating circuit and outputting data signals in response thereto, control signal generating circuits 4*a* and 4*b* which form part of a scanning driving circuit device and scanning signal output circuits 3*a* and 3*b* for receiving control signals from control signal generating circuits 4*a* and 4*b*, respectively, and outputting scanning signals in response thereto.

Figure 2:
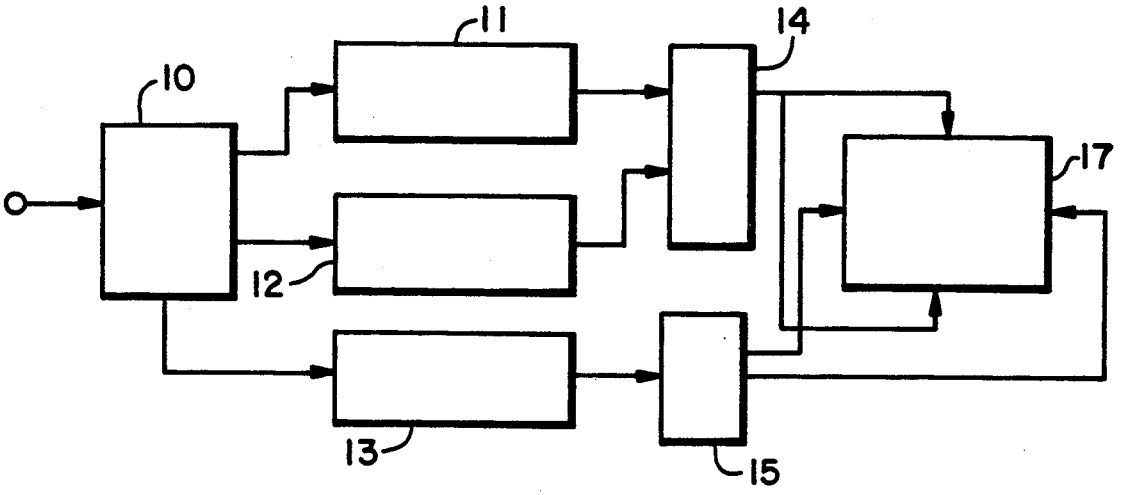
FIG. 2 (PRIOR ART)
FIG. 2 is a block diagram of a conventional driving circuit for the display device in FIG. 1.
Figure 3:
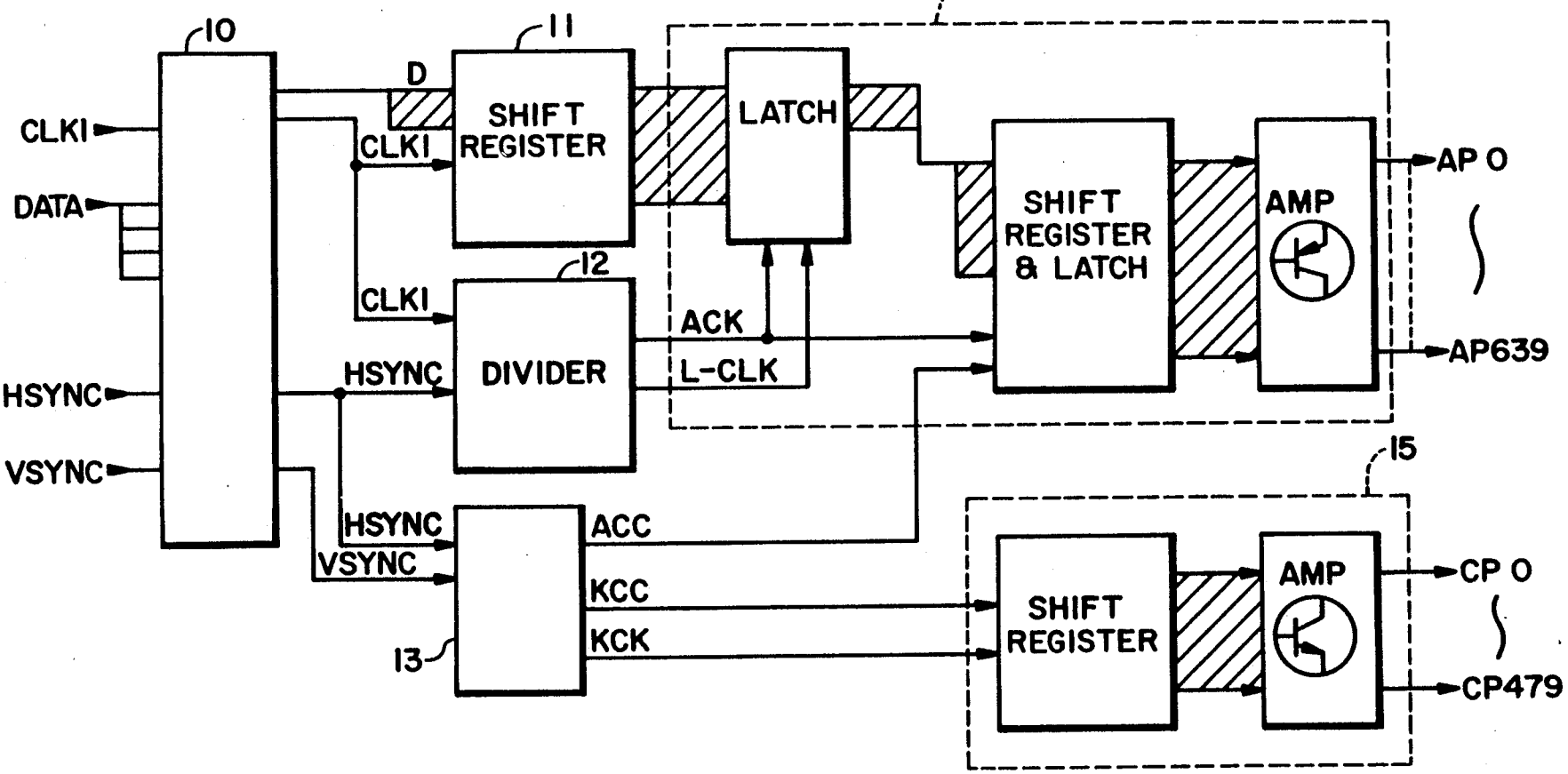
FIG. 3 (PRIOR ART)
FIG. 3 is a detailed circuit diagram of FIG. 2.

FIG. 2 is a block diagram showing the driving circuit of a conventional gaseous discharge display device. FIG. 3 shows a detailed circuit diagram of FIG. 2.

In the diagram, reference numeral 10 is a driving signal input circuit for inputting signals which are generated including display timing signals together with clock signals CLK1; that is, vertical synchronization signal VSYNC, horizontal synchronization signal HSYNC and display data DATA.

11 is a data clock signal processing circuit which includes a shift register for receiving data D and clock signal CLK1 from driving input circuit 10 and outputting decoded data.

12 is a data driving synchronization signal generating circuit for receiving horizontal synchronization signal HSYNC and clock signal CLK1 from the input circuit and generating synchronization signals such as anode clock signal ACK and latch clock signal L-CLK by dividing clock signal CLK1.

13 is a scanning driving synchronization signal generating circuit for receiving vertical synchronization signal VSYNC and horizontal synchronization signal HSYNC from the driving signal input circuit 10 and for generating anode clear signal ACC which controls the data driving circuit, and also generating cathode clear signal KCC and the cathode clock signal KCK.

14 is a data driving circuit for temporarily storing input data; for example the data of 640 pixels that are supplied to 1 scan line from shift register 11 to the latch circuit in response to synchronization signals supplied from data driving synchronization signal generating circuit 12, and outputting anode pulses APO to AP639 generated as a function of the input pixel data and in response to anode clear signal ACC.

15 is a scanning driving circuit for receiving signals such as cathode clear signal KCC and cathode clock signal KCK generated from scanning driving synchronization signal generating circuit 13 and outputting cathode pulses CPO to CP479 in response thereto.

17 is a display panel for receiving anode pulses APO to AP639 generated from data driving circuit 14 by way of a plurality of signal electrode columns 4 and for receiving cathode pulses CPO to CP479 generated from scanning driving circuit 15 by way of a plurality of scan electrode rows, together forming a screen having display resolution of 640×480 dots.

Next, the operation of the discharge display device having the aforementioned construction is described hereinafter.

Figure 6A:
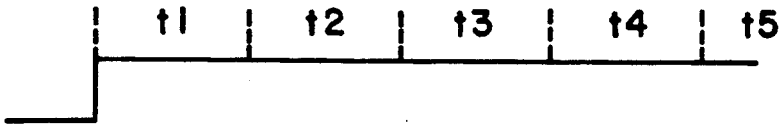

If display timing signals are input at driving signal input circuit 10 from a picture signal source (not shown), clock pulses such as the waveform in FIG. 6A are output from a driving signal input circuit 10 to operate the respective scan line.

Clock pulse waveform as shown in FIG. 6A is the clock pulse corresponding to 1 frame cycle in which a scan operation is to be performed.

The clock pulses output from driving signal input circuit 10 are supplied to data clock signal processing circuit 11, driving synchronization signal generating circuit 12 corresponding to a data driving circuit stage, and scanning driving synchronization signal generating circuit 13 corresponding to a scanning driving circuit stage.

On the one hand, scan lines which act as the scan electrodes are divided into odd rows and even rows from top to bottom. Therefore, to scan lines of odd rows and even rows sequentially, clock signal frequencies are distributed into odd rows and even rows respectively in accordance with cathode clock signal KCK supplied from scanning driving synchronization signal generating circuit 13.

Figure 6B:
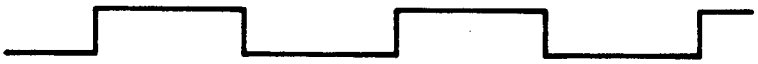
Figure 6C:
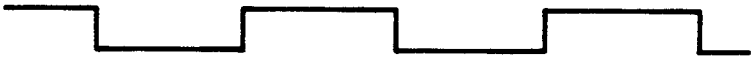

As a result, pulse signals such as the waveforms shown in FIGS. 6B and 6C are generated.

The waveform shown in FIG. 6B is one of the scan frequency signals output form scanning signal output circuit 3*b* and is provided for scanning the scan lines corresponding to rows of the panel. On the other hand, the waveform shown in FIG. 6C is one of the scan frequency signals output from the scanning signal output circuit 3*a* and is provided for scanning scan lines corresponding to even rows of the panel.

When the frequency-waveform shown in FIG. 6B is scanned within period t1, then the frequency-waveform shown in FIG. 6C is scanned within period 12. When the frequency-waveform shown in FIG. 6B is scanned within period t3 again, then the frequency-waveform shown in FIG. 6C is scanned within period t4.

Figure 6D:
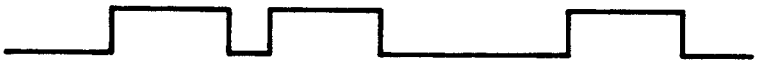
Figure 6E:
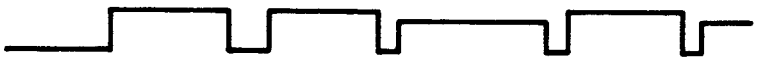

Herein, if data is input as shown by the waveform in FIG. 6D and synchronized with the cycle of scanning, a main discharge like that shown by the waveform in FIG. 6E is generated in response to the waveform as shown in FIG. 6B and the waveform as shown in FIG. 6D during period t1. A main discharge like waveform as shown in FIG. 6E is generated by the waveform as shown in FIG. 6C and the waveform as shown in FIG. 6D during period t2. But during period t3, no main discharges occur since no pixels need to be discharged when there are not data, as such, represented in the waveform as shown in FIG. 6D.

In practice, however, the scan operation occurs continuously even when display data is not applied, thereby the problem of unnecessary power consumption arises. This is because auxiliary discharge is generated at the crosspoint between a signal electrode and a scan electrode and screen contrast is therefore reduced. The scan electrode applies a scan driving voltage continuously and the signal electrode charges residual charges when display data is not being applied.

Figure 4:
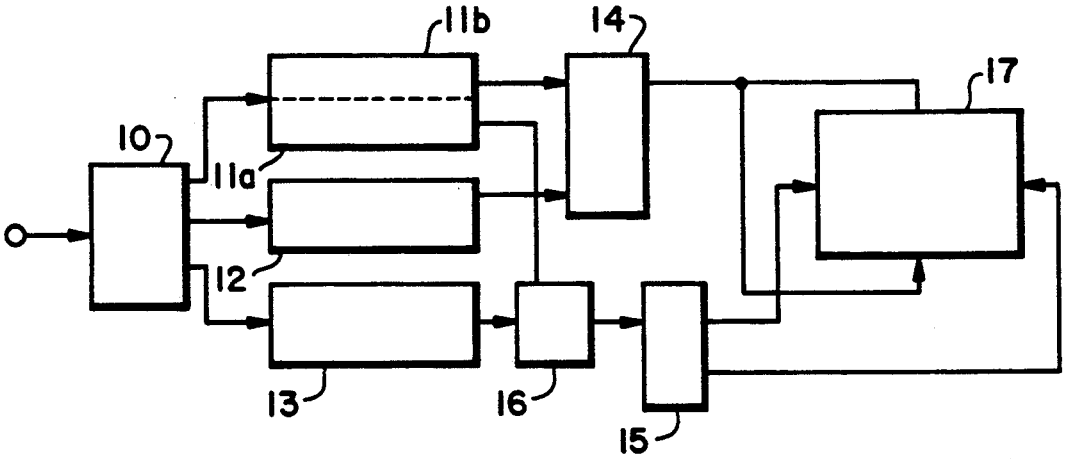
FIG. 4 is a block diagram of a driving circuit of a display device according to the present invention.

FIG. 4 shows a diagram of the driving circuit of the gaseous discharge display device according to the present invention. The difference between FIG. 4 and FIG. 2 is given in that in the present invention data/clock signal processing circuit 11 is divided into input/output counter 11*a*, for checking for input/output data, and data/clock signal processing circuit 11*b*, for processing the data signals and input clock signals. Scanning control circuit 16 is also provided between control signal generating circuit 13 and scanning driving circuit 15. The detailed circuit diagram of input/output counter 11*a* and scanning control circuit 16 is shown in FIG. 5.

Therefore, the difference which the present invention has compared with conventional driving circuits is that it is constructed such that synchronization signals are generated from scanning driving synchronization signal generating circuit 13 and selectively passed through scanning control circuit 16 and then the scanning driving synchronization signals are applied to the scanning driving circuit 15, instead of applying the synchronization signals directly to the scanning driving circuit 15 as in the prior art.

Figure 5:
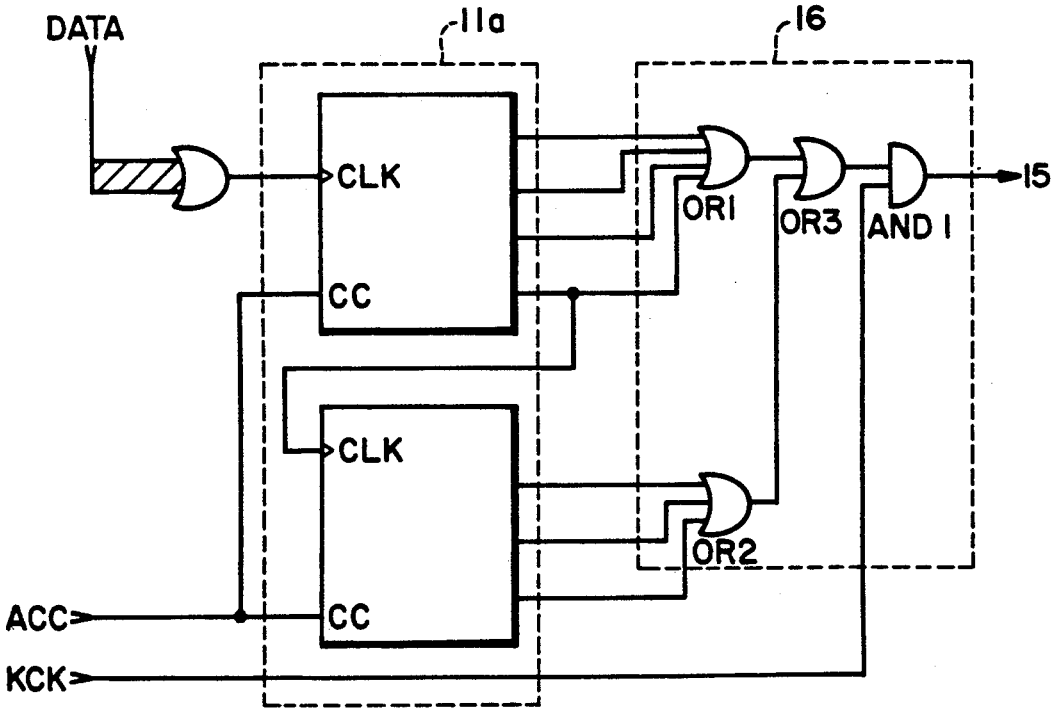
FIG. 5 is a detailed circuit diagram of a data input/output counter and a scanning control circuit according to the present invention; and, FIGS. 6A–6F show output waveforms for a conventional driving circuit and for the driving circuit of the present invention.

FIG. 5 will be described in detail below. Data counter 11*a* receives revised data, which are composed of 4 bits per pixel, from the data/clock signal processing circuit 11*b* and counts the data (4 bit×160=160 dots) that are applied to each scan line from 0 to 159. To accomplish the aforementioned operation, it is constructed so that two 4 bit-counters are linked.

The output terminal of data counter 11*a* is connected to the input terminals of 4-input OR gate OR1 and 3-input OR gate OR2 while the output terminals of these OR gates OR1 and OR2 are connected to the 2-input OR gate OR3. THe output terminal of the OR gate OR3 is connected to AND gate AND1 with cathode clock output terminal KCK. The AND gate AND1 is connected to an enabled terminal KEN of scanning driving circuit 15.

Accordingly, if at least one of the revised data of 4 bits is input into data counter 11*a*, data input signals of high level are output into the AND gate AND1 through the OR gate OR3. At this time, the AND gate AND1 outputs enable signal KEN for driving scanning driving circuit 15 so long as cathode clock signal KCK, which is the driving signal for each scanning line, is applied to another input terminal.

On the other hand, no signals are output through the OR gate OR3 when no data are applied to the data counter 11*a* so that no enable signal KEN can be output from the AND gate AND1 even though cathode clock signal KCK which drives scanning driving circuit 15 is applied to the input terminal of AND gate AND1. As a result, the driving of a scanning line is suppressed when no data is input.

The operation of the driving circuit according to the present invention wherein the driving of the scanning lines in controlled depending on the presence of the applied data will be described, referring to the time chart shown in FIGS. 6A–6F.

Figure 6F:
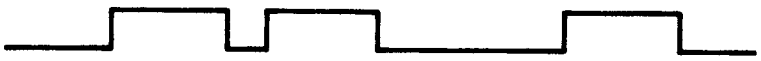

Specifically, if data is input represented by the waveform as shown in FIG. 6D and synchronized with the cycle of scanning, the scanning operation results in the waveform as shown in FIG. 6F. This is the output waveform due to discharge effects of the present invention in response to the waveform as shown in FIG. 6D during period t1.

On the other hand, during period t3 in which there are no display data signals input into the display element driving circuit, data/clock signal processing circuit 11*b* and data input/output counter 11*a* detect the no data available state and cause scanning control circuit 16 to control the type of scanning signals that are applied to the scanning driving circuit through the scanning control circuit 16 from the scanning driving signal generating circuit 13.

As a result, the waveform as shown in FIG. 6F is generated which shows low level signals being produced during period t3 when there are no display data inputs.

As described above, the present invention includes a data counter for checking the presence of data prior to performing a scanning operation to drive a gaseous display device.

As a result, the present invention reduces unnecessary power consumption of scanning operations by preventing auxiliary discharge effects when there is no display data being input. Thus, in a gaseous display device, the contrast ratio can be increased.

What is claimed is:

1. A gaseous discharge display processing circuit including a display matrix panel for generating an image thereon, data driving means for driving electrode columns of said display matrix panel associated with externally provided data signals, scan driving means for driving scan line electrode rows of said display matrix panel, data input means for receiving said externally provided data signals together with timing signals, data/clock signal processing means responsive to said data signals and said timing signals for generating control signals and pixel data signals to said data driving means, and scan synchronization signal generating means responsive to said timing signals from said data input means for generating scan line synchronization signals, said gaseous discharge display processing circuit further comprising:

data counter means coupled to said data/clock signal processing means for receiving said pixel data and generating scan line pixel count information in response thereto;

and scan control means responsive to said scan line pixel count information from said data counter means and select ones of said scan synchronization signals for generating a scan line enable signal to said scan driving means in response thereto, wherein said scan line enable signal is inactive when either no pixel data is available or when said selected synchronization signals indicate a no scan operation.

2. The gaseous discharge display processing circuit of claim 1, wherein said data counter means receives 4-bit pixel data and counts up from 0 to 159 corresponding to 160 pixels associated with a scanning line.

3. The gaseous discharge display processing circuit of claim 1, wherein said scan control means comprises:

means for OR-ing the scan line pixel count information received from said data counter means; and means for AND-ing the OR-ed output together with said selected synchronization signals to generate said scan line enable signal.

* * * * *